United States Patent [19]

Auclair et al.

[11] Patent Number: 5,055,056

[45] Date of Patent: Oct. 8, 1991

[54] GROUND WIRE CONNECTOR

[75] Inventors: William T. Auclair, Winsted; Randolph L. Auclair, New Hartford, both of Conn.

[73] Assignee: Electric Motion Company, Inc., Winsted, Conn.

[21] Appl. No.: 614,207

[22] Filed: Nov. 16, 1990

[51] Int. Cl.[5] ..... H01R 4/66

[52] U.S. Cl. ..... 439/98; 439/778; 439/781; 248/61; 411/385; 411/400

[58] Field of Search ..... 439/98, 778, 779, 780, 439/791, 793, 807, 815, 92, 801, 781, 782, 100; 248/61, 68.1, 74.1; 411/385, 400, 401; 403/235, 290, 354, 99

[56] References Cited

U.S. PATENT DOCUMENTS

| | | | |
|---|---|---|---|
| 634,766 | 10/1899 | Roche | 439/810 |
| 1,695,007 | 12/1928 | Cawood | 439/801 |
| 1,991,075 | 2/1935 | Bloomquist | 439/811 |
| 2,077,613 | 4/1937 | Bondeson | 439/100 |
| 2,084,109 | 6/1937 | Ribble et al. | 439/809 |
| 2,471,957 | 5/1949 | Hubbard | 439/778 |
| 4,131,257 | 12/1978 | Sterling | 439/781 |
| 4,159,859 | 7/1979 | Shemtov | 439/100 |
| 4,195,895 | 4/1980 | Ziegler | 439/99 |
| 4,449,768 | 5/1984 | Koncelik et al. | 439/99 |
| 4,526,428 | 7/1985 | Sachs | 248/61 |
| 4,620,755 | 11/1986 | Yonkers et al. | 439/99 |
| 4,623,204 | 11/1986 | Auclair | 439/800 |
| 4,784,621 | 11/1988 | ASuclair | 439/793 |
| 4,828,504 | 5/1989 | Franks, Jr. | 439/92 |

*Primary Examiner*—Gary F. Paumen

*Attorney, Agent, or Firm*—Chilton, Alix & Van Kirk

[57] ABSTRACT

An electrical connector adapted for connecting a ground wire to a service wire employs a clamp arm having a bifurcated head which clamps the ground wire. A nut mounted to a threaded shaft of the arm is tightened to force a sleeve to engage exterior surfaces of the arm to clamp the ground wire. A pair of service wires may be secured by a bow tie type connector band disposed between the sleeve and the lock nut.

19 Claims, 3 Drawing Sheets

GROUND WIRE CONNECTOR

BACKGROUND OF THE INVENTION

This invention relates generally to connectors for electrical cables and the like. More particularly, the present invention relates generally electrical connectors employed for securing ground wires to service cables.

Numerous connectors have been advanced for connecting ground wires to cables. For buried service wires to which the invention has particular applicability, a continuous Number 6 AWG ground wire is frequently employed for grounding. Application constraints for ground connectors employed with buried service applications include providing a connection of high mechanical integrity, providing selective axial positioning of the grounding wire and accommodating relatively small headroom constraints. In addition, it is often desirable to ground between a pair of parallel service cables.

Connectors to which the invention relates are disclosed in the following references:

| Patentee | U.S. Pat. No. |
|---|---|
| Franks, Jr. | 4,828,504 |
| Auclair | 4,784,621 |
| Auclair | 4,623,204 |
| Yonkers et al | 4,620,755 |
| Sachs | 4,526,428 |
| Koncelik et al | 4,449,768 |
| Ziegler | 4,195,895 |
| Shemtov | 4,159,859 |
| Sterling | 4,131,257 |
| Hubbard | 2,471,957 |
| Ribble et al | 2,084,109 |
| Bondeson | 2,077,613 |
| Bloomquist | 1,991,075 |
| Roche | 634,766 |

SUMMARY OF THE INVENTION

Briefly stated, the invention in a preferred form is a ground wire connector comprising a connector member having a bifurcated head and an integral threaded shaft. The head defines a pair of opposed recesses for partially receiving a ground wire. In the unclamped state, a tapered outer surface is disposed at a lower portion of the head and an upper portion of the shaft. A sleeve or collar includes an axial opening and is mountable on the shaft for sliding axial displacement thereon. The sleeve is dimensioned to engage the tapered surface at upper interior portions of the sleeve. A locking member such as a hex-head nut is threadably mountable to the shaft. The locking member is axially displaceable to force the sleeve axially wherein upon inserting a ground wire between the recesses, the sleeve engages the tapered surfaces and cams the head into a clamped engagement with the ground wire. A second wire disposed between the lock nut and the sleeve is secured to the connector in a force-fit connection.

In one embodiment, the ground connector is adapted for connecting a ground wire to a pair of buried cables. The connector comprises a continuous overlapping band which defines a pair of laterally spaced channels for receiving the cables in parallel spaced relationship. The connector band defines an axial opening. A connector member having an axially bifurcated head and a threaded shaft is received in the opening. A pair of opposed slots in the head receive a ground wire. The head includes tapered exterior surfaces. A sleeve is mounted to the shaft on one side of the band and is axially displaceable on the shaft. The sleeve is dimensioned at an upper inner portion to engage the tapered surface. A locking member such as a hex-head nut is threadably mounted on the shaft at a second side of the connector band and is tightenable to clamp the first connector against cables received in the channels and also to force the sleeve to cam against the surfaces to clamp the head against a ground wire disposed between the slots.

In another embodiment, the locking nut defines a slot which receives the second wire. A set screw is threaded to the nut for projection into the slot to secure the wire.

An object of the invention is to provide a new and improved connector for connecting a ground wire to an electrical cable.

Another object of the invention is to provide a new and improved ground wire connector having a pre-assembled form which is relatively easily positionable along the axis of the wire and is easily mounted, installed and positioned.

A further object of the invention is to provide a new and improved ground wire connector which is capable of 360 degree angular positioning and maintains the selected angle upon tightening or loosening the connector.

A yet further object of the invention is to provide a new and improved ground wire connector which is capable of being easily installed in applications having severe headroom constraints and is installable with one hand using standard tools.

Other objects and advantages of the invention will become apparent from the drawing and the specification.

DETAILED DESCRIPTION OF THE PREFERRED EMBODIMENTS

Figure 1:
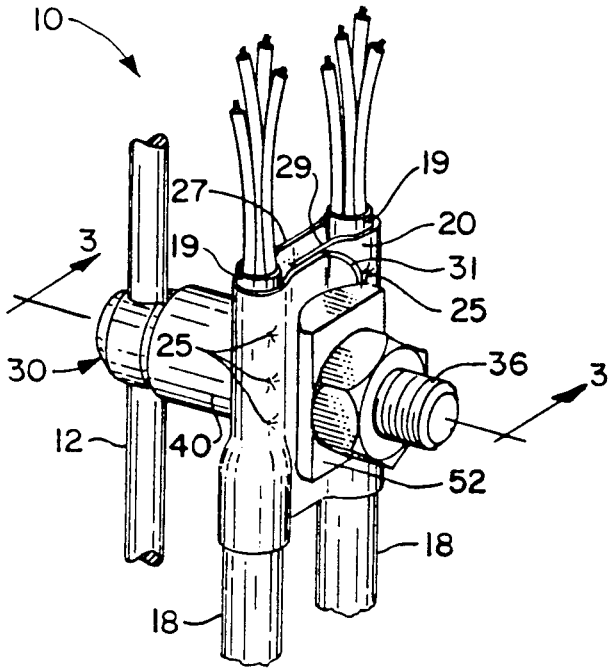
FIG. 1 is a perspective view of the ground wire connector in accordance with the present invention illustrated in conjunction with a pair of service cables and a ground wire.
Figure 2:
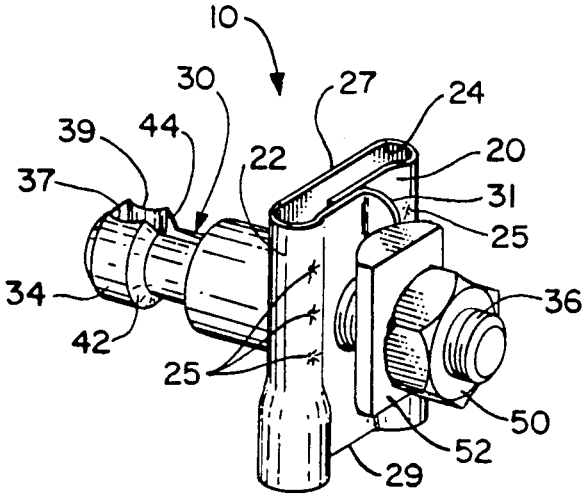
FIG. 2 is a second perspective view of the ground wire connector of FIG. 1 illustrated in a pre-installation mode.
Figure 3:
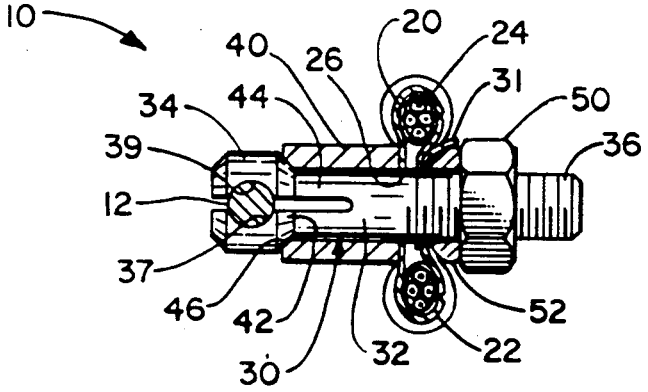
FIG. 3 is a sectional view of the ground wire connector of FIG. 1 taken along the lines 3—3 thereof.

With reference to the drawings wherein like numerals represent like parts throughout the several figures, a ground wire connector in accordance with the present invention is generally designated by the numeral 10 in FIGS. 1-3. The ground wire connector 10 is particularly adaptable for use in connection with connecting a ground wire 12 with a pair of service cables 14 and 16. The cables have an outer sheath 18 which has been partially removed to expose the metallic shield 19. The connector may be employed to bond and ground buried service wires to a grounding wire in pedestals, aerial terminals and buried enclosures. The connector 10 has particular applicability in connection with a continuous No. 6 AWG ground wire.

The ground wire connector 10 includes a band clamp 20 and a clamp arm assembly 30 which cooperate to provide an efficient and reliable bonding between the ground wire and the service wires. The band clamp comprises a semi-flexible band of brass or copper which is folded into a bow tie type configuration which forms two laterally spaced, opposing channels 22 and 24 of generally semi-cylindrical shape. The channels flare to provide an enlarged diameter portion at one end. The channels 22 and 24 are dimensioned for tightly wrapping around the service wires in a bonded-type clamping configuration wherein the shield of the service wire is engaged by the reduced channel portion and the outer sheath is engaged by the enlarged portion. The enlarged portion provides a strain relief in the clamped configuration so that the service cable shield will be less suspectible to breakage by the clamping against the outer sheath. An axial opening 26 extends through spaced portions of the band and is generally centrally disposed between the channels 22 and 24. A plurality of indentations 25 may be punched in the channel walls to facilitate a biting engagement with the service wire. The band clamp may be visualized as thus having a slightly concave-sectioned panel 27 and an opposed overlapping slightly concave panel 29 which forms a dual layer and terminates in an upturned lip 31.

Figure 7:
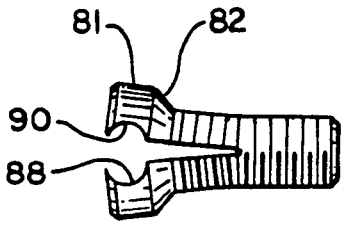
FIG. 7 is a perspective view of a clamp member component of the connector of FIG. 6.

The clamp arm assembly 30 comprises an elongated clamp member 32, a clamp sleeve 40 and a lock nut 50. The clamp member 32 includes an axially bifurcated head 34 and a threaded shaft 36. The head and upper portions of the shaft are spread apart in the unclamped mode in a quasi-V-shaped configuration as illustrated in FIG. 7. A pair of opposed cooperative arcuate slots 37 and 39 of the bifurcated head 34 are dimensioned to be generally commensurate or slightly smaller than the diameter of the ground wire 12, so that when the ground wire is placed between the slots and the head sections are forced together, the clamped ground wire is securely bonded and positioned. The clamp member is preferably manufactured from brass, copper or other suitable electrically conductive material.

In the unclamped mode, the head sections are spaced apart. Lower exterior surfaces 42 and 44 of the head or upper shaft are axially tapered in the unclamped mode so that their combined diameters generally decrease toward the threaded shaft. The sleeve 40 has a central opening which is greater than the diameters of the threads to provide for a sliding displacement along the threaded shaft. The sleeve has an upper interior surface 46 (portions of which may be tapered) which is dimensioned and engagable with the exterior surfaces 42 and 44 of the clamp member, so that as the sleeve is axially displaced toward the head, the sleeve interior surface 46 cams against surfaces 42 and 44 to clamp the head sections against the received ground wire 12. In the clamped state, the V-shaped head and shaft separation is generally eliminated, and the shaft portion of the clamp arm has a generally uniform diameter throughout its longitudinal extent.

In one form of the invention such as illustrated in FIGS. 1-3, the threaded shaft is inserted through opening 36 and an elongated spacer element 52 having a convex section is mounted to the shaft and secured by the lock nut 50. It will be appreciated that the clamp sleeve 40 and the spacer/lock nut are disposed on opposing sides of the clamp band. As the lock nut is tightened against the spacer element 52, the spacer element is forced inwardly against the flexible band clamp in a cam-like engagement to tighten the band clamp against the service wires 14 and 16. Simultaneously, the exterior surfaces of the clamp head cam against the clamp sleeve to also clamp the ground wire 12 in position. The lip 31 engages the spacer element 52 to prevent rotation. In some embodiments, the spacer element is threaded and functions as the nut.

Figure 8:
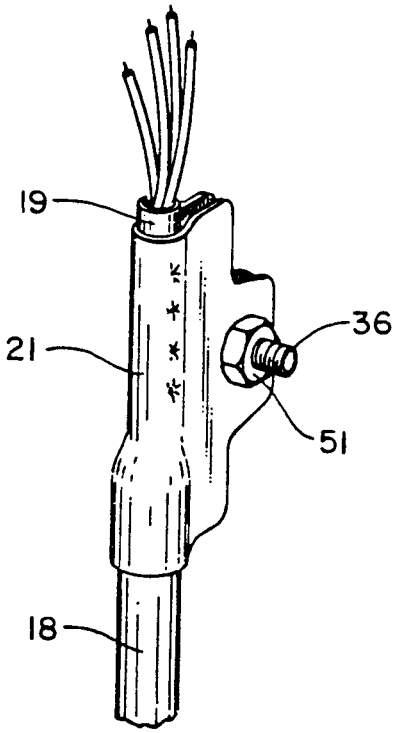
FIG. 8 is a perspective view of a fifth embodiment of a ground wire connector in accordance with the present invention illustrated in conjunction with a service wire.

In an alternate embodiment such as illustrated in FIG. 8, the band clamp 21 is constructed of thicker, less flexible material and the spacer element is not required. In addition, the lock nut 51 is secured to the band clamp by a grommet-like flange which retainably engages the opposing side of the band clamp. The band clamp 21 illustrated in FIG. 8 is adapted for only a single service cable. The bank has application for installation where the service cable wires are spaced at different distances along the ground wire.

It will be appreciated that the ground wire and the service wires are clamped substantially simultaneously by applying a torque to the lock nut by a conventional standard terminal wrench. The angular orientation of the ground wire may be selectively positioned, for example, in parallel with the service wires, or any other desired angle of orientation. The angular orientation may be preserved during either the tightening or loosening of the lock nut. It will be appreciated that the connector has particular applicability in connection with buried sevice wires which employ a continuous No. 6 AWG ground wire. In addition, the clamp band can be displaced along the axis of the service wire to a desired position and the connector clamp head is also easily positionable along the ground wire to provide for facile positioning. The resulting clamp connection provided by the connector provides a bond of high mechanical strength. It will be appreciated that the connector may essentially take the form of a single assembly such as illustrated in FIG. 2. In its pre-assembled state, there are thus no loose components. In addition, the connector can be installed with essentially a one hand installation.

Figure 4:
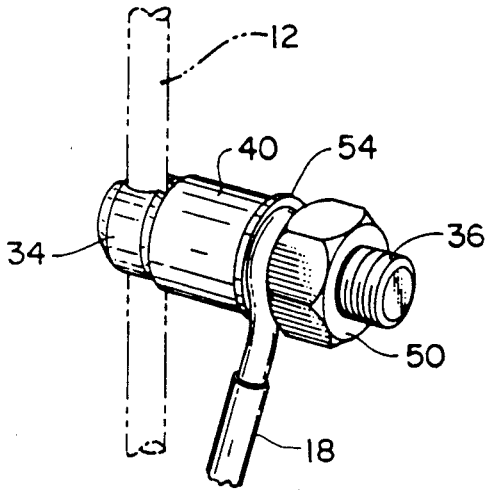
FIG. 4 is perspective view of a second embodiment of a ground wire connector in accordance with the present invention illustrated in conjunction with a ground wire in phantom and a connecting wire.

In another embodiment of the invention such as illustrated in FIG. 4, the clamp arm assembly 30 is directly locked in force-fit fashion to a solid No. 10 AWG or other suitable wire. A retaining washer 54 is disposed at the bottom of the clamp sleeve and engages against one side of the wire. The opposing side of the wire 18 is engaged by the lock nut 50. Application of a torque to the lock nut secures both the wire 18 and a ground wire 12 inserted between the bolt head 34 of the clamp arm. The FIG. 4 embodiment allows for essentially universal angular orientation of both wires 12 and 18.

Figure 5:
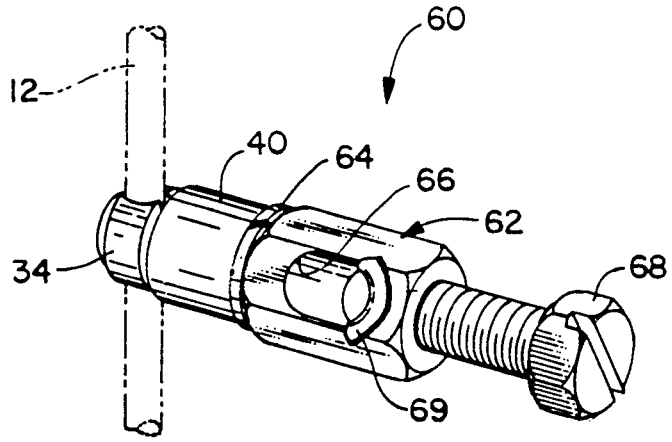
FIG. 5 is a perspective view of a third embodiment of a ground wire connector in accordance with the present invention illustrated in conjunction with a ground wire in phantom.

With reference to FIG. 5, an alternate embodiment of a ground wire connector is generally designated with a numeral 60. Wire connector 60 does not employ the band clamp, but uses a hex connector 62 for shield grounding. The threaded shaft is threaded into an opening (not illustrated) of the hex connector. A lock nut washer 64 is disposed between the sleeve 40 and the hex connector. The hex connector 62 functions in manner analogous to lock nut 50 and is then torqued against the washer, which correspondingly forces the clamp sleeve to cam the ground wire in bonded position as described for connector 10. The hex connector 64 has an axially enlarged body which includes a slot 66 for receiving a wire. The wire is secured in position by an axially positionable set screw 68 which projects into the slot 66. An arcuate clamp element 69, having a pair of retainer flanges to retain the element with the hex connector, may be positioned in slot 66 between the wire and the end of the set screw to facilitate the clamping engagement with the wire.

Figure 6:
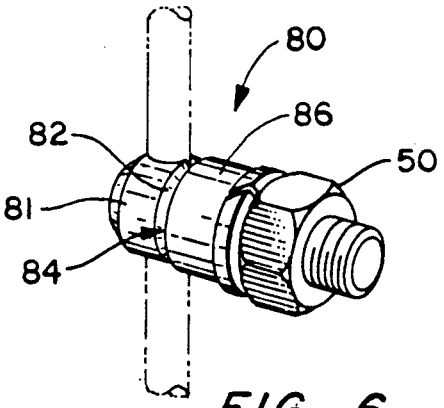
FIG. 6 is a perspective view of a fourth embodiment of a ground wire connector in accordance with the present invention illustrated in conjunction with a ground wire in phantom.

With reference to FIG. 6, another embodiment of a ground wire connector in accordance with the present invention is illustrated generally by the numeral 80. The connector head 81 has a bevelled surface 82. A corresponding complementary tapered surface 84 is formed on the clamp sleeve 86. The axial dimension of the sleeve 86 is on the same order as the corresponding dimensions of the lock nut 50 and the connector 81 head. With reference to FIG. 7, the arcuate slots 88 and 90 formed in the connector head are slightly smaller than the diameter of the wire for which the connector 80 is adapted. The threaded shaft 86 extends to the termination of the bevelled surface of the head.

It will be appreciated that all of the foregoing connectors 10, 60 and 80 provide devices wherein a ground wire may be easily connected to a service wire, cable or other conductor in an efficient installation process which allows for the ground wire to be oriented at a desired position with respect to the connected wire. All of the connectors can be mounted or installed in position under relatively severe headroom constraints and provide an electrical bond of a high mechanical strength.

While the preferred embodiments of the foregoing invention have been set forth for purposes of illustration, the foregoing description should not be deemed a limitation of the invention herein. Accordingly, various modifications, adaptations and alternatives may occur to those skilled in the art without departing from the spirit and the scope of the present invention.

What is claimed is:

1. A ground wire connector comprising:

clamp arm means for clamping against a ground wire, said clamp arm means comprising an axially bifurcated head and a threaded shaft, said head being dimensioned to receive said ground wire, said clamp arm means having a tapered outer surface adjacent said head;

sleeve means defining an axial opening and mountable on said shaft for slidable axial displacement thereon, said sleeve being dimensioned to engage said tapered surface; and locking means threadably mountable to said shaft and axially displaceable to secure a second wire disposed between said sleeve means and said locking means in a force-fit and to force said sleeve means and tapered outer surface into engagement wherein said sleeve means cams said tapered surface to force said head into clamped engagement with said ground wire.

2. The ground wire connector of claim 1 wherein said head defines a pair of opposed slots which cooperate to closely receive said ground wire in a clamped engagement of the head.

3. The ground wire connector of claim 2 wherein said slots have arcuate shapes complementary to the surface of the ground wire.

4. The ground wire connector of claim 1 wherein said locking means comprises a hex-head nut.

5. The ground wire connector of claim 1 wherein said shaft has two upper portions which are biased apart in an unclamped state and wherein said sleeve means comprises a sleeve having a generally cylindrical inside surface engageable with said tapered surface to transform said upper portions into a generally cylindrical configuration in the clamped state.

6. The ground wire connector of claim 1 wherein said bifurcated head is separated in a quasi-V-shaped configuration in an unclamped state.

7. The ground wire connector of claim 1 further comprising an overlapping band mounted to said shaft between said sleeve means and said locking means, said band adapted to receive said second wire.

8. The ground wire connector of claim 7 wherein said band is semi-flexible and further comprising a spacer element disposed between said locking means and sleeve means and engageable against said band to tighten said band against said second wire.

9. The ground wire connector of claim 8 wherein said spacer element has a generally convex engagement surface.

10. The ground wire connector of claim 7 wherein said locking means comprises a nut retainably mounted to said band.

11. A ground wire connector comprising:

first connector means comprising an overlapping band forming a pair of laterally spaced channels for receiving laterally spaced wires, said band defining spaced axial openings therethrough;

second connector means comprising a connector member comprising a bifurcated head and a threaded shaft receivable in said axial openings, said head having head portions configured to cooperatively grip a ground wire received therebetween and having an exterior engagement surface;

sleeve means mounted to said shaft and axially positionable relative to said shaft for engaging said engagement surface; and locking means threadably mounted to said shaft and positionable to clamp said band against a wire received by a said channel and force said sleeve means and engagement surface together to cam said head portions into a clamping engagement with a ground wire disposed therebetween.

12. The ground wire connector of claim 11 wherein said band has a first surface and a second surface, said sleeve means being positioned opposite said first surface and said locking means being positioned opposite said second surface.

13. The ground wire connector of claim 11 wherein said locking means comprises a nut and a spacer element mounted to said shaft, said spacer element being disposed between said band and said nut.

14. The ground wire connector of claim 11 wherein said band has a bow tie shaped configuration.

15. The ground wire connector of claim 11 further comprising a plurality of indentations projecting into said channels.

16. The ground wire connector of claim 11 wherein said shaft projects generally orthogonally to a plane defined by said channels.

17. The ground wire connector of claim 11 wherein the channels have a reduced diameter portion and an enlarged diameter portion.

18. The ground wire connector of claim 11 wherein an end portion of said band is upturned and engages against the spacer element.

19. The ground wire connector of claim 11 wherein said spacer element has a convex surface which cams against the band.

* * * * *